United States Patent [19]

Kirma

[11] Patent Number: 4,972,165

[45] Date of Patent: Nov. 20, 1990

[54] ELECTRICAL STRUCTURAL COMPONENT

[75] Inventor: Safa Kirma, Holstein, Fed. Rep. of Germany

[73] Assignee: Messerschmitt-Boelkow-Blohm GmbH, Munich, Fed. Rep. of Germany

[21] Appl. No.: 376,611

[22] Filed: Jul. 7, 1989

[30] Foreign Application Priority Data

Jul. 8, 1988 [DE] Fed. Rep. of Germany ..... 3823184

[51] Int. Cl.[5] ..... H01H 51/22

[52] U.S. Cl. ..... 335/83; 335/202

[58] Field of Search ..... 335/78–85, 335/120, 124, 128, 230, 202, 121–123; 200/295, 305

[56] References Cited

U.S. PATENT DOCUMENTS 4,554,521 11/1985 Hurter ..... 335/128

4,801,908 1/1989 Weaver ..... 335/83

4,812,794 3/1989 Asbell et al. ..... 335/83

*Primary Examiner*—H. Broome

*Assistant Examiner*—Lincoln Donovan

*Attorney, Agent, or Firm*—W. G. Fasse; D. H. Kane, Jr.

[57] ABSTRACT

An electrical structural component including a relay and connection contacts for connecting electrical components of the relay with respective electrical conductors of a switching or energizing circuit and at least one operating circuit, is equipped with a connector mounting plate that can be inserted into a relay housing. Connector bushings and securing or locking elements which may be part of the bushings, for the mounting and fixation of contact pins are arranged in the connector mounting plate. The connector bushings are constructed as carriers for the spring contacts operated in the relay and simultaneously as connector arms for the fixed contacts. The contact pins are connected to respective conductors.

12 Claims, 2 Drawing Sheets

ELECTRICAL STRUCTURAL COMPONENT

FIELD OF THE INVENTION

The invention relates to an electrical structural component including a relay for the activation of at least one operating circuit, by means of an operating member acting upon electrical contact springs. The component also includes connector elements to connect electrical members of the relay, such as a solenoid coil, with electrical conductors of a switching cirucit for energizing the solenoid coil and with at least said operating circuit. The relay also includes an armature for actuating the operating member.

BACKGROUND INFORMATION

Electrical structural components of the above type are installed in a plurality of electrical circuits. In most cases, these components comprise an electromagnetic relay equipped with a row of contact pins, and a socket equipped with connector bushings into which contact pins of inlet conductors are insertable. The connector bushings are thereby simultaneously connected to the corresponding electrical conductors forming the switching or energizing and the operating circuit or circuits. In this manner, the socket can serve simultaneously for producing the necessary electrical connections between the relay and the various circuits, and for providing a mounting and support for the relay, whereby the socket is rigidly connected with a respective base, for example, a printed circuit board.

In the utilization of this type of electrical structural component in specialized fields in which a plurality of various electrical connections need to be made in the smallest available space, as is the case in the field of aeronautics and space technology, it has been a problem that for every switching task a relay type with the necessary number of electrical connections and for every relay type a correspondingly constructed and coded mounting socket must be made available and hence held in stock. Furthermore, the known structural components of this type often take up a considerable space.

OBJECTS OF THE INVENTION

In view of the foregoing, it is the aim of the invention to achieve the following objects singly or in combination:

to construct an electrical structural component so that it is as compact as possible;

so that it makes possible the activation of a plurality of various circuit connections in as simple a manner as possible; and to enable the formation of a plurality of different types of circuit connections by the same relay.

SUMMARY OF THE INVENTION

A structural component according to the invention is characterized by a mounting plate insertable into a housing of the relay.

Connector bushings and locking or retaining elements, for the mounting and fixation of contact pins connected to electrical conductors, are arranged in said mounting plate.

The integration of a relay with a connector mounting plate or socket according to the invention, achieves an optimal compactness of such structural components. Simultaneously the necessity for a coding of various sockets which were once required to reliably prevent a defective mounting of a relay and socket, is avoided. The invention inherently prevents a defective or rather faulty mounting.

Further advantageous features of the invention are seen in that, the connector bushings are simultaneously carriers of or mounts for the spring contacts which are activated by the operating member of the relay and also carriers for the connections to be formed by these spring contacts. Likewise, for a further simplified construction it is advantageous that the connector mounting plate is locked into or arrested in the housing of the relay and that a cover plate of an elastic rubber material is provided. Further, in structural components that are required to simultaneously activate a plurality of operating circuits, it is advantageous that the connector bushings are arranged in a circle in the connector mounting plate.

BRIEF DESCRIPTION OF THE DRAWINGS

In order that the invention may be clearly understood, it will now be described, by way of example, with reference to the accompanying drawings, wherein.

Figure 1:
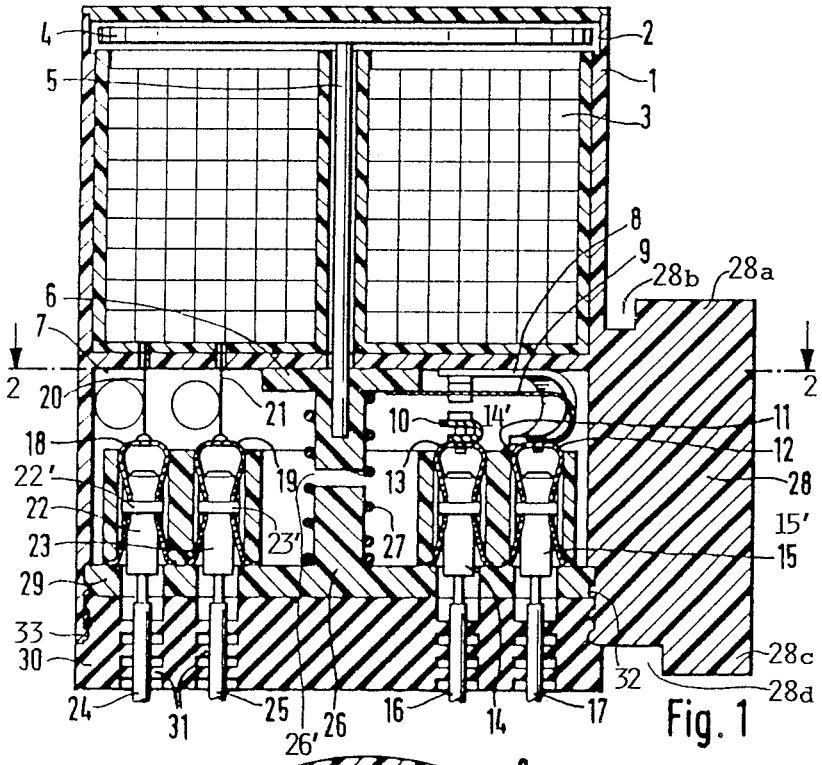
FIG. 1 is a vertical section through an electrical structural component comprising a relay with an integrated socket or base structure.

DETAILED DESCRIPTION OF PREFERRED EXAMPLE EMBODIMENTS AND OF THE BEST MODE OF THE INVENTION

In the figures, the same component parts are denoted with the same reference characters.

Figure 2:
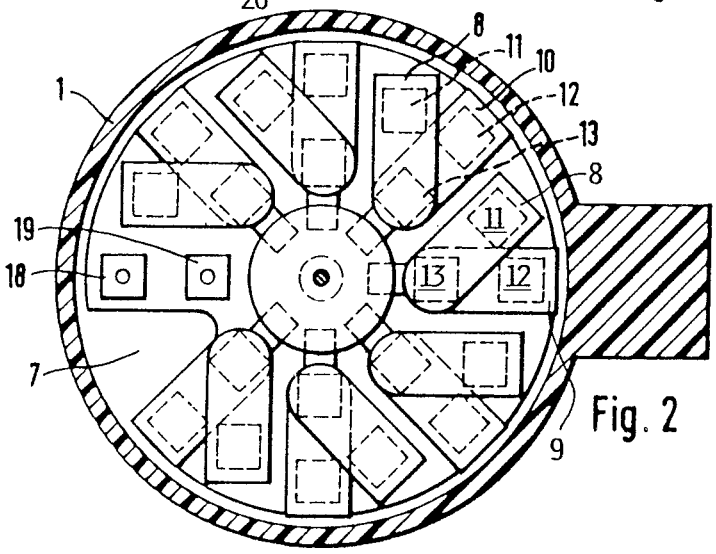
FIG. 2 shows a horizontal section according to the section line 2—2 through the arrangement of FIG. 1.

The relay shown in FIGS. 1 and 2 is an electromagnetic relay that, in the case of the shown example embodiment, simultaneously activates a total of seven operating circuits.

A shielded magnet 3 is arranged in an upper chamber 2 in the internal part of a cylindrical housing 1. As shown, the magnet 3 cooperates with a disk-shaped armature 4 which is movable in a vertical axial direction in a space above the shielded magnet 3. The armature 4 is connected by a rod 5 extending through the center of the shielded magnet 3, with a disk-shaped contact operating member 6 located in the internal part of a second lower chamber 7 below the upper chamber 2.

In this second chamber 7 there are, as particularly shown in FIG. 2, a plurality of contact arrangements 8, 9, 10 grouped in ring fashion around the centrally mounted contact operating member 6. In the shown example embodiment there are altogether seven such contact arrangements.

Each of these contact arrangements comprises two curved or arc-shaped contact arms 8 and 9 between which a curved or arc-shaped contact spring 10 is arranged. All three contact elements 8, 9, 10 carry electrical switch contacts at their free ends and are rigidly secured at their other ends to electrically conducting connector bushings 11, 12, 13 also serving as a mounting for contact pins 14 and 15 arranged at the ends of electric conductors 16 and 17 which are component parts of respective operating or working circuits, activated by the relay. Thus, the bushings 11, 12, 13 simultaneously hold the contact pins 14, 15 and also carry the contact elements 8, 9, 10.

Two further connector bushings 18 and 19 belong to the switching circuit that leads through electric conductor elements 20 and 21 to the shielded magnet 3 or rather to its solenoid coil for operating the armature 4. Contact pins 22 and 23 are introduced in the connector bushings 18 and 19 and lead to electrical conductors 24 and 25 of the switching or magnet energizing circuit. Further, a spring mounting member 26 centrally located on the floor of the lower chamber 7, carries a reset spring 27.

The other end of said reset spring 27 is supported by the underside or flange portion of the operating member 6.

As can be further seen from FIGS. 1 and 2, a lateral mounting member 28 is a as an integral piece to the housing 1. The outer form or profile cross-section of said mounting member 28 is adapted to the shape or profile of a support rail, not represented here, to which the structural component can be secured. For this purpose the mounting member 28 has an upper shoulder **28*a* forming a recessed groove 28*b*, and a lower shoulder 28*c* forming a recessed groove 28*d*. Thus, the support rail can engage the grooves 28*b* and 28*d* to hold the housing 1**.

According to the invention, the base of the housing 1 is formed as a connector mounting plate 29 of electrically insulating materials for carrying connector bushings 11, 12, 13, 18, and 19. The plate 29 is held or arrested in the housing by locking elements 32 and closes the lower chamber 7. The arrangement is completed by an elastic rubber cover plate 30 that can be locked into the housing 1 by further locking elements 33, thereby simultaneously further securing the mounting plate 29 into place. The cover plate 30 is provided with corresponding through-holes for the electric conductors 16, 17, 20 and 21. Lip-type sealing elements 31 fitting around the insulation casing of the electric conductors 16, 17, 20 and 21, keep the area containing the connector bushings 11, 12, 13, 18, and 19 free of dust and moisture.

Figure 3:
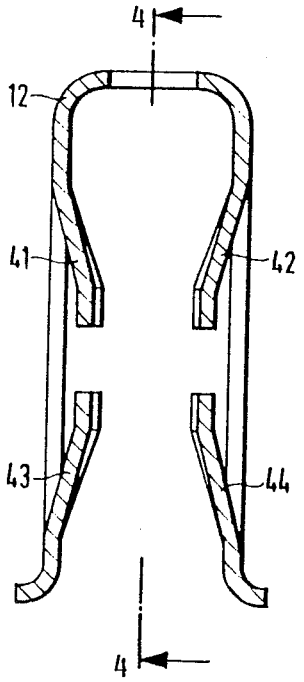
FIG. 3 is a vertical section through a connector bushing.
Figure 4:
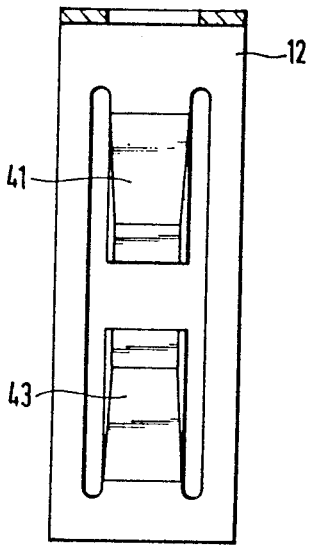
FIG. 4 shows a horizontal section according to the section line 4—4 through the arrangement of FIG. 3.

As can be seen in the enlarged detailed example of one of the connector bushings shown in FIGS. 3 and 4, the connector bushings as represented here by connector bushing 12, comprise tongue-shaped contact elements 41, 42, 43 and 44 arranged opposite one another in pairs. These contact elements 41, 42, 43 and 44 hug the inserted contact pins 14, 15, 22, 23 as seen in FIG. 1, with their free ends meeting the outer surface of the respective contact pins. In the case of connector bushing 12 this would be the contact pin 15. The upper contact elements 41, 42 of each bushing are angled radially inwardly and downwardly relative to a central longitudinal axis of each bushing for engaging a ring shoulder or flange 14', 15', 22', 23' of the respective contact pin 14, 15, 22, 23 thereby limiting the insertion depth of the pins into the connector bushings. The lower contact elements 43, 44 are angled radially inwardly and upwardly relative to the longitudinal axis of the respective connector bushing. Thus, the lower contact elements 43 and 44 function simultaneously as safety elements, in that after the insertion of contact pin 15 they grasp behind the respective ring-shoulder of the contact pin thereby locking the pin into place against withdrawal. The contact pin 15 is in this way locked into the connector bushing 12 and thereby is secured against unintentional loosening or removal.

For the loosening of this mounting and the removal of the contact pin 15, or any contact pin, from the connector bushing 12, a corresponding tool that comprises a freely movable sleeve slipped over the casing of the electric conductor 17 is provided. The sleeve can be slipped past the lip-type sealing elements 31 of the cover plate 30 into the connector bushing 12. The external diameter of said sleeve is so dimensioned that it corresponds to the internal diameter of the connector bushing 12, while the internal diameter of said sleeve corresponds to the external diameter of the contact pin in the area below the ring shoulder 14'. The contact and safety elements 43 and 44 are pushed radially outwardly by inserting the sleeve into the connector bushing 12 as just described, whereby the contact pin 15 or pins can be removed. The sleeve is not shown in the drawings but it functions as just described.

If a switching or operating current is applied to the solenoid coil of the electromagnet 3 of the above described arrangement, the current will flow through the conductors 24, 25 and the conductor elements 20 and 21 and through the coil of the shielded magnet 3, whereby the armature 4 will be pulled up by the magnet. The force of the reset spring 27 is directly transmitted through the rod 5 onto the operating member 6. In this way, the connection between all contact springs 10 and contact arms 8 is simultaneously interrupted, while immediately thereafter these contact springs 10 connect with the contact arms 9. During an interruption of the operating current and the thereby caused abatement of the magnetic force which acts upon the armature 4, the restoring force of the reset spring 27 takes over and the relay returns to its starting position as shown in FIG. 1.

A spacing 26' between the spring mounting member 26 and the operating member 6 limits the downward movement of the operating member 6. Further downward movement of the operating member 6 stops when the operating member 6 abuts against the spring mounting member 26.

Although the invention has been described with reference to specific example embodiments, it will be appreciated that it is intended to cover all modifications and equivalents within the scope of the appended claims.

What I claim is:

1. An electrical structural component, comprising relay means including electrical contact means (8, 9, 10) including spring contact means and contact operating means for activating at least one operating circuit, connector elements (20, 21) for connecting said relay means to switching circuit means, a housing (1) for containing said relay means (3, 4, 5), said housing including a mounting member (28) with a cross-section adapted for mounting said housing (1), an electrically insulating connector bushing mounting plate (29) insertable into an opening in said housing (1), insert channels in said connector bushing mounting plate, connector bushings (11, 12, 13, 18, 19) fixed in said insert channels of said connector bushing mounting plate (29), and retaining means (43, 44) in said insert channels for holding and fixing contact pins in said connector bushings, said connector bushings having ends facing away from said connector bushing mounting plates, at least certain of said bushing ends supporting said contact means for cooperation with said contact operating means, whereby respective bushings simultaneously hold said contact pins and carry said contact means.

2. The electrical structural component of claim 1, wherein said retaining means (43, 44) are part of said connector bushings (12, 13, 18, 19).

3. The electrical structural component of claim 1, wherein said relay means comprise a central longitudinal axis, said contact operating means comprising an axially movable armature of said relay means and a contact operating member (6) carried by said armature for operating said contact means in response to an axial movement of said armature.

4. The electrical structural component of claim 3, wherein said electrical spring contact means comprise spring arms supported by said connector bushings.

5. The electrical structural component of claim 1, further comprising locking elements (32) for arresting said connector mounting plate to said housing.

6. The electrical structural component of claim 1, further comprising housing cover means (30) made of rubber elastic material and arresting elements (33) for securing said cover means to said housing.

7. The electrical structural component of claim 1, wherein at least certain of said insert channels are arranged in said connector mounting plate on a circle around a central longitudinal relay axis.

8. The electrical structural component of claim 7, wherein said insert channels have longitudinal axes extending in parallel to said relay axis.

9. The electrical structural component of claim 1, wherein said retaining means are formed as elastically yielding tongues integral with said connector bushings.

10. The electrical structural component of claim 1, wherein said connector bushings comprise elastically yielding contact tongues forming an integral part of said connector bushings.

11. The electrical structural component of claim 1, wherein said retaining means are formed as elastically yielding tongues integral with said connector bushing, said tongues reaching radially inwardly into the respective connector bushing for engaging behind a shoulder of said contact pins to prevent a withdrawal of said contact pins out of said connector bushings.

12. The electrical structural component of claim 1, wherein said connector bushings comprise elastically yielding contact tongues forming an integral part of said connector bushings, said tongues reaching radially inwardly into the respective connector bushing for engaging a shoulder of said contact pins to limit an insertion depth of said contact pins into said connector bushings.

* * * * *